US011402188B1

(12) United States Patent
Manley et al.

(10) Patent No.: US 11,402,188 B1
(45) Date of Patent: Aug. 2, 2022

(54) PYROTECHNIC DELAYED EXTENDED RANGE SHOTGUN MUNITION

(71) Applicant: U.S. Government as Represented by the Secretary of the Army, Dover, NJ (US)

(72) Inventors: David Chalfant Manley, Budd Lake, NJ (US); Sean Mulvihill, Lake Hiawatha, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 17/407,470

(22) Filed: Aug. 20, 2021

Related U.S. Application Data

(60) Provisional application No. 63/071,690, filed on Aug. 28, 2020.

(51) Int. Cl.
*F42B 14/06* (2006.01)
*F42B 7/04* (2006.01)
*F42B 14/08* (2006.01)

(52) U.S. Cl.
CPC ..... *F42B 14/08* (2013.01); *F42B 14/061* (2013.01); *F42B 14/064* (2013.01); *F42B 14/065* (2013.01)

(58) Field of Classification Search
CPC ..... F42B 10/04; F42B 10/06; F42B 10/38; F42B 10/40; F42B 12/56; F42B 12/62; F42B 12/64; F42B 14/06; F42B 14/064; F42B 14/065; F42B 7/02; F42B 7/04; F42B 7/08; F42B 7/12
See application file for complete search history.

(56) References Cited

U.S. PATENT DOCUMENTS 44,353 A * 9/1864 Tripp ..... F42B 10/40 102/490
2,382,152 A * 8/1945 Jakobsson ..... F42B 14/064 89/14.6
2,461,555 A * 2/1949 Linsley ..... F42B 12/64 102/456
2,638,051 A * 5/1953 Critchfield ..... F42B 14/064 102/522
2,715,874 A * 8/1955 Hablutzel ..... F42B 14/02 102/523
3,000,316 A * 9/1961 Dunlap ..... F42B 14/064 102/523
3,180,265 A 4/1965 Rybak
(Continued)

FOREIGN PATENT DOCUMENTS

GB 9419864 11/1994

*Primary Examiner* — Derrick R Morgan
(74) *Attorney, Agent, or Firm* — John P. DiScala

(57) ABSTRACT

A two piece aerodynamic pusher consisting of a body and tailpiece. This pusher fits into a standard 40 mm cartridge case by means of three sabots. After the cartridge case is functioned, the combustion gases push the projectile forward and ignite a delay column located in the rear of the pusher. Upon muzzle exit, the sabots discard and the pusher continues down range as the delay column burns. Once the delay has burned, a charge located in the pusher body is ignited, pushing the payload out of the front of the projectile. The cap pops off, and the pellets are dispersed. This effectively moves the payload release point from the muzzle until a designated point down range based on the delay length.

16 Claims, 3 Drawing Sheets

(56) References Cited

U.S. PATENT DOCUMENTS 3,186,342 A * 6/1965 Hancock, Jr. ..... F42B 14/064 102/523
3,349,712 A * 10/1967 Schwager ..... F42B 14/064 102/522
3,405,638 A * 10/1968 Stoner, Jr. ..... F42B 7/02 102/458
3,447,466 A * 6/1969 Engel ..... F42B 14/064 102/522
3,507,220 A * 4/1970 McClure ..... F42B 7/04 102/463
3,507,221 A * 4/1970 Grolly ..... F42B 14/064 102/518
3,568,603 A * 3/1971 Vartanian ..... F42B 7/06 102/456
3,724,378 A * 4/1973 Knight ..... F42B 12/64 102/448
3,730,095 A 5/1973 Lage
3,744,426 A * 7/1973 Butler ..... F42B 14/02 102/527
3,762,332 A 10/1973 Witherspoon
3,771,455 A * 11/1973 Haas ..... F42B 12/64 102/377
3,812,784 A 5/1974 Herter
3,877,383 A 4/1975 Flatau
3,919,799 A 11/1975 Austin
3,982,489 A 9/1976 Flatau
3,991,682 A 11/1976 Peak
4,000,698 A * 1/1977 Corney ..... F42B 14/064 102/522
4,036,141 A * 7/1977 Korr ..... F42B 5/035 102/443
4,154,012 A 5/1979 Miller
4,212,244 A 7/1980 Flatau
4,296,687 A * 10/1981 Garrett ..... F42B 14/064 102/518
4,389,939 A * 6/1983 Ofuji ..... F42B 7/04 102/458
4,476,785 A 10/1984 Hoffman
4,505,202 A * 3/1985 Fidler ..... F42B 14/06 102/357
4,505,204 A * 3/1985 Wikstrom ..... F42B 14/064 102/523
4,553,481 A * 11/1985 Ricci ..... F42B 7/08 102/458
4,590,862 A 5/1986 Grabarek
4,706,569 A * 11/1987 Wallow ..... F42B 12/06 102/521
4,726,298 A * 2/1988 Sigg ..... F42B 14/064 102/527
4,750,425 A 6/1988 Sigg
4,800,816 A * 1/1989 Meyer ..... F42B 14/064 102/523
4,841,867 A * 6/1989 Garrett ..... F42B 14/064 102/523
4,936,219 A * 6/1990 Mudd ..... F42B 10/06 102/520
5,012,744 A 5/1991 Sowash
5,239,928 A * 8/1993 Ricci ..... F42B 5/067 102/439
5,644,100 A * 7/1997 Puckett ..... F42B 7/08 102/449
5,834,682 A * 11/1998 Warren ..... F42B 5/15 102/505
5,969,289 A 10/1999 Bisping
6,105,506 A 8/2000 Gangale
6,701,848 B1 3/2004 Georgantzis
6,814,006 B2 * 11/2004 Johansson ..... F42B 14/068 102/522
7,228,801 B2 * 6/2007 Dunnam ..... F42B 12/38 102/458
7,243,603 B2 7/2007 Sheaffer
7,451,702 B1 * 11/2008 Dindl ..... F42B 12/62 102/438
8,511,232 B2 8/2013 Scarr
8,622,000 B2 1/2014 Meyer
8,887,641 B1 * 11/2014 Manole ..... F42B 14/06 102/521
9,360,223 B1 * 6/2016 Billings ..... F42B 7/04
9,528,806 B2 12/2016 Rossmann
9,658,038 B1 * 5/2017 Dunnam ..... F42B 7/02
1,040,859 A1 9/2019 Manley
10,422,611 B1 * 9/2019 Moser ..... F42B 7/08
10,584,947 B1 3/2020 Manley
2002/0088897 A1 * 7/2002 Davis ..... F42B 10/06 244/3.24
2004/0107826 A1 * 6/2004 Simmons ..... F41A 1/02 89/8
2010/0077934 A1 * 4/2010 Heitmann ..... F42B 14/064 102/523
2010/0212533 A1 * 8/2010 Brunn ..... F42B 7/02 102/502
2013/0145951 A1 * 6/2013 Nauman ..... F42B 7/04 102/448
2014/0155200 A1 * 6/2014 Flint ..... F42B 12/362 473/577
2015/0330754 A1 11/2015 Bierman
2017/0261292 A1 * 9/2017 Armstrong ..... F41H 11/02
2019/0162512 A1 * 5/2019 Pinoteau ..... F42B 10/14
2019/0301844 A1 * 10/2019 Garst ..... F42B 10/26
2020/0363176 A1 * 11/2020 Pigott ..... F42C 9/10

* cited by examiner

PYROTECHNIC DELAYED EXTENDED RANGE SHOTGUN MUNITION

CROSS-REFERENCE TO RELATED APPLICATIONS

This application claims the benefit under 35 USC § 119(e) of U.S. provisional patent application 63/071,690 filed on Aug. 28, 2020.

STATEMENT OF GOVERNMENT INTEREST

The inventions described herein may be manufactured, used and licensed by or for the United States Government.

FIELD OF THE INVENTION

The invention relates in general to munitions and in particular to payload delivering munitions.

BACKGROUND OF THE INVENTION

Traditional shotgun cartridges release their payload immediately after exiting the barrel. As the shot flies down range the shot column naturally spreads out as it travels down range. This results in a lower density of pellets at extended ranges, which reduces the probability of being able to deliver the intended effects to the target. These effects are even more prevalent when the cartridge is fired from a rifled barrel, like a traditional 40 mm weapon system.

In order to mitigate this issue in the past, attempts were made to release the pellets without disturbing the payload. Another approach utilized a pusher design in which the pusher flies an extended range before drag on the pusher causes it to pull off of the payload. However, these efforts still result in a limit effective range.

A need exists for an improved projectile which overcomes these limitations and increases the effective range of the projectile.

SUMMARY OF INVENTION

One aspect of the invention is a projectile further comprising a pusher assembly, a payload, a cap, a payload ejector, a charge assembly, a sabot assembly and a segmented slip band. The pusher assembly further comprises a pusher body defining an interior housing, and a pusher tail connected to the rear of the pusher body. The payload is housed within the pusher body. The cap is connected to the front of the pusher body for retaining the payload within the pusher body prior to ejection. The payload ejector is housed within the rear of the pusher body and is configured for pushing the payload forward. The charge assembly deploys the payload at a desired time after exiting the weapon barrel. The sabot assembly is coaxial with and partially surrounding the pusher assembly. The segmented slip band is coaxial with and seated in a groove on an exterior of the sabot assembly. The segmented slip band rotates freely within the groove thereby minimizing the spin imparted on the pusher body and separates into one or more segments upon exit from a weapon system.

Another aspect of the invention is a forty millimeter projectile further comprising a pusher assembly, a pellet payload, a cap, a payload ejector, a delay charge, an energetic charge, a sabot assembly and a segmented slip band. The pusher assembly further comprises a pusher body defining an interior housing and a pusher tail connected to the rear of the pusher body. The pellet payload is housed within the pusher body. The cap is snap fit connected to the front of the pusher body for retaining the payload within the pusher body prior to ejection. The payload ejector is located within the pusher body and to a rear of the payload assembly. The delay column is located in a rear of the pusher tail and ignited by a propellant charge of the projectile. The delay column is configured for burning a predetermined amount of time before igniting the energetic charge. The predetermined amount of time selected to achieve a desired range before ejecting the payload. The energetic charge is ignited by the delay column and configured for pushing the payload ejector forward thereby translating the payload forward to separate the cap from the pusher body and eject the payload. The sabot assembly is coaxial with and partially surrounding the pusher assembly. The segmented slip band is coaxial with and seated in a groove on an exterior of the sabot assembly. The segmented slip band rotates freely within the groove thereby minimizing the spin imparted on the pusher body and separates into one or more segments upon exit from a weapon system. The segmented slip band further comprises a groove for receiving a corresponding protrusion of a cartridge case to hold the segmented slip band in place prior to being fired.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

Figure 1:
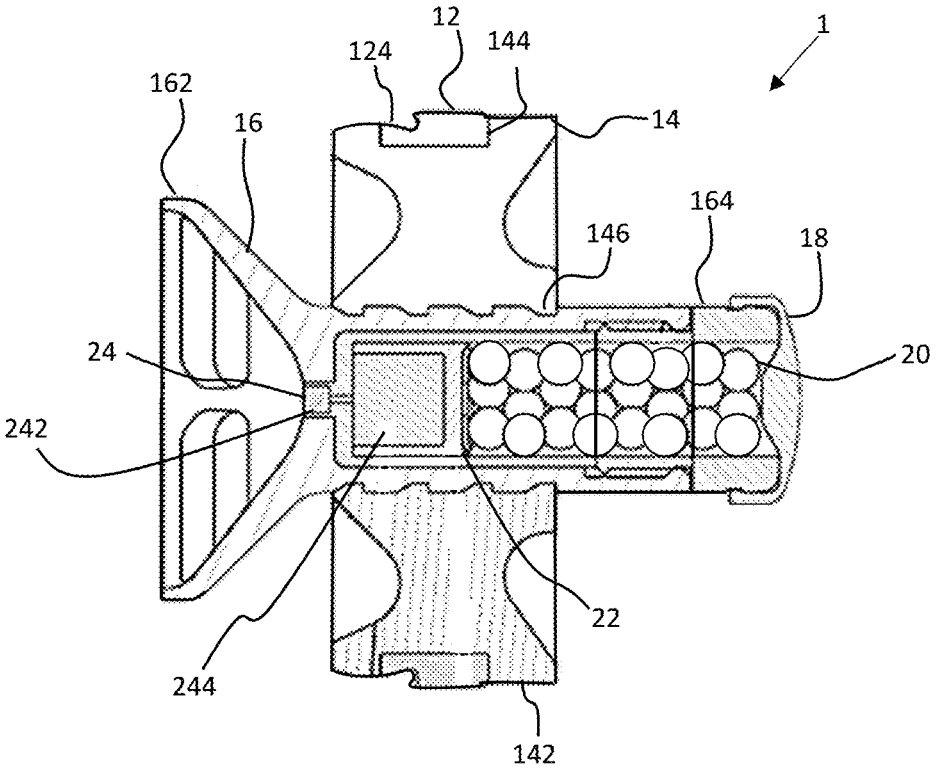
FIG. 1 is a cross-sectional view of a projectile, according to an illustrative embodiment.

A projectile delivers a pellet payload to an increased range with increased accuracy. A two piece aerodynamically stable pusher consists of a body and tailpiece. This pusher fits into a standard 40 mm cartridge case by means of three sabots. After the cartridge case is functioned, the combustion gases push the projectile forward and ignite a delay column located in the rear of the pusher. Upon muzzle exit, the sabots discard and the pusher continues down range as the delay column burns. The pusher is aerodynamically stable so that it can fly in a stable manner before releasing the payload. Once the delay has burned, a charge located in the pusher body is ignited, pushing the payload out of the front of the projectile. The cap pops off, and the pellets are dispersed. This effectively moves the payload release point from the muzzle until a designated point down range based on the delay length. This results in a tighter pattern down range then what is possible with a traditional projectile design. This also allows the effective range to be adjusted, based on the pyrotechnic delay.

To seal against combustion gases, a three piece split rotating band is employed. To allow for the integration of a segmented slip band, the slip band features a crimp groove, which allows the cartridge case to hold them in place before for the projectile is fired. By decoupling the aerodynamic pusher from the rotating band, spin up in the barrel can be minimized. This reduction in rotation results in less centripetal force imparted to the pellets which, in turn, allows the pellets to hold a tighter pattern upon exiting the pusher. The segmented slip bands also reduce the amount of blow-by.

The slip band also increases the reliability of the projectile in a low velocity system. Traditionally, slip bands are a single piece, which the force of the sabot breaks after the projectile leaves the muzzle. However, in a lower velocity environment, like a 40 mm platform, the segmented design gives the same benefit of reducing the spin imparted to the projectile while also allowing the sabots and slip band to release more cleanly and easily from the pusher thereby reducing disturbance to the pusher. This also increases the reliability of the release of the sabots.

The release of the pellets down range can be with just enough force to release the pellets from the pusher body in order to minimize the disturbance to the payload pattern, or the payload can be pushed out for an increased velocity to increase the effectiveness of the payload on target. In addition, the force of pushing the payload forward can also be used to push the pusher body backward. This can be used to reduce the forward velocity of the pusher, or to stop its forward momentum completely in order to reduce the collateral damage risks of this projectile. This is especially beneficial in non-lethal and other applications where collateral damage is a concern.

Those skilled in the art will recognize that the projectile can also be adapted for use with other calibers besides 40 mm such as small caliber ammunition, up through large caliber ammunition. For example, this technology could be utilized for shotgun ammunition in order to increase the effective range of the cartridge, or to increase the velocity of the pellets down range.

Additionally, instead of utilizing a pyrotechnic delay, a time based fuze, RF programmable fuze, or a command detonation fuze could be incorporated in order to function the energetic material at the appropriate time.

Figure 2:
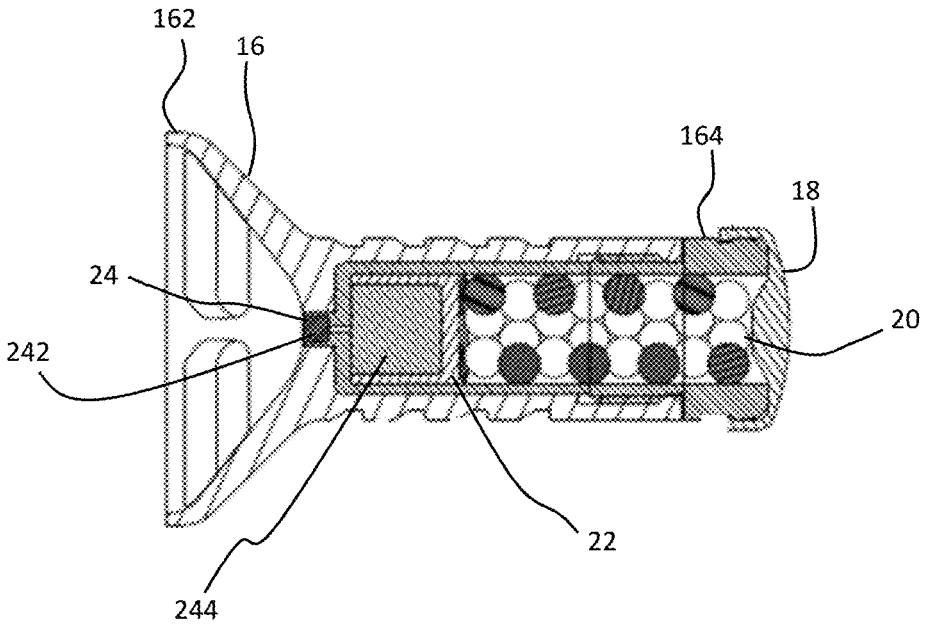
FIG. 2 is a cross-sectional view of a projectile in a projected state, according to an illustrative embodiment.
Figure 3:
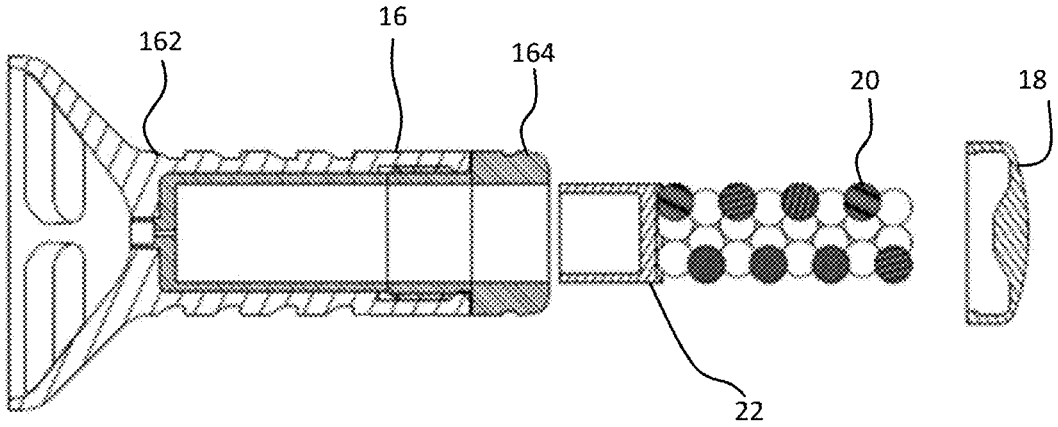
FIG. 3 is a cross-sectional view of a projectile in a released state, according to an illustrative embodiment.

FIG. 1 is a cross-sectional view of a projectile, according to an illustrative embodiment. FIG. 2 is a cross-sectional view of a projectile in a projected state, according to an illustrative embodiment. FIG. 3 is a cross-sectional view of a projectile in a released state, according to an illustrative embodiment. The projectile 1 further comprises a segmented slip band 12, a sabot assembly 14, a pusher assembly 16, a cap 18, a payload 20, a payload ejector 22 and a charge assembly 24. In the embodiment shown, the charge assembly 24 further comprises a delay charge 242 and an energetic charge 244.

The pusher assembly 16 serves as the main structure of the projectile 1. The pusher assembly 16 further comprises a pusher tail 162 and a pusher body 164.

The pusher body 164 houses the payload 20, energetic charge 244 and the payload ejector 22. The pusher body 164 features a snap groove for the cap 18 to interface with, and a threaded interface to connect with the pusher tail 162. The pusher body 164 and pusher tail 162 can also be attached by other means, or the pusher tail 162 could be molded onto the pusher body 164. In addition the cap 18 could also be attached to the pusher body 164 by other means than a snap.

The pusher tail 162 creates an aerodynamic profile for the projectile 1, interfaces with the pusher body 164, and also provides an interface to mate with the sabots 142.

The sabot assembly 14 is comprised of one or more sabots 142 and extends circumferentially around the pusher tail 162. The sabot assembly 14 need not extend to the front of the projectile 1 due to the use of a cap 18 which attaches to the pusher body 164 without the sabot assembly 14. The relatively short length of the sabots 142 are selected to reduce the overall mass of the projectile 1 and allow for increased muzzle velocities, while still remaining under the recoil limit of the weapon system. The sabots 142 features several grooves 146 that mate with the pusher tail 162.

The sabots 142 along with the slip band 12 seal the propellant gasses, and are used to propel the projectile 1 down the barrel. The sabots 142 feature a groove 144 extending around the external circumference to allow the slip band 12 to freely rotate, while minimizing the amount of spin imparted to the rest of the projectile 1. The sabot assembly 14 is held in place by the crimped segmented slip band 12 and the interface features 146 with the pusher assembly 16. Upon the segmented slip band 12 separating after firing, the sabot assembly 14 also separates.

The segmented slip band 12 is seated around the exterior of the sabot assembly 14. The segmented slip band 12 further comprises a plurality of segments 122 which together form a slip band 12. The segments are in contact but not mechanically connected to each other.

The segmented slip band 12 allows the projectile 1 to fully seal in the rifling of the weapon system barrel in order to reduce blow by and to utilize the propellant efficiently. In addition, the segmented slip band 12 reduces the spin imparted to the pusher assembly 16 in order to reduce the spread of the payload 20 at extended ranges.

Further, the segmented slip band 12 also allows for a low velocity, reliable discard of the slip band 12 and sabot assembly 14 without reducing the forward momentum or disturbing the pusher assembly 16. As the projectile 1 exits the gun barrel, the segments 122 of the segmented slip band 12 separate and travel outward from the sabot assembly 14 without requiring the sabot assembly 14 to impart force to break them apart.

To allow for the integration of a segmented slip band 12, the slip band 12 features a crimp groove 124, which allows the cartridge case to hold them in place before for the projectile 1 is fired. The crimp groove 124 extends around the exterior circumference of the segmented slip band 12. When the projectile 1 is seated in a cartridge case, the cartridge case is crimped at the crimp groove 124 thereby holding the segmented slip band 12 in place until the cartridge is fired. Once the cartridge is fired, the cartridge case no longer restrains the segmented slip band 12 and the segmented slip band 12 is free to separate upon leaving the weapon barrel.

The cap 18 attaches to the front of pusher body 164 with a snap fit. In other embodiments, the cap 18 could also be affixed to the pusher body 164 through other means such as threads, adhesives, molding or other means. The cap 18 retains the payload 20 until the pyrotechnic delay charge 242 ignites the energetic charge 244 and pushes the payload ejector 22 forward. The cap 18 is snapped into a groove on the pusher body 164.

The payload 20 is housed within the pusher body 164 and retained by the cap 18. The projectile 1 is particularly suited to deliver a payload 20 which is not unitary. The payload 20 can consist of steel pellets, tungsten pellets, rubber pellets, powders, streamers, or any other payload that can be delivered to a target.

The delay charge 242 is ignited by the propellant gasses and burns for a set time before igniting the energetic charge 244. This delay charge 242 allows the projectile 1 to fly an extended range before releasing the payload 20, and can be tailored for the desired effect. The delay charge 242 can be black powder, propellant, tracer material, or any other material which burns and can ignite the energetic charge 244.

The energetic charge 244 can be any material such as propellants, black powder, or any other material that creates a pressure or force on the payload ejector 22 in order to push the payload forward.

The payload ejector 22 is propelled forward by the energetic charge 244, forcing the pellets forward and popping the lid off of the pusher body 164. This force can be adjusted to slowly release the pellets or it can be used to increase the velocity of the pellets significantly. In addition, the forward momentum of the payload ejector 22, the payload 20, and the cap 18 can be used to reduce the forward momentum of the pusher body 16, or to stop its forward momentum completely.

While the invention has been described with reference to certain embodiments, numerous changes, alterations and modifications to the described embodiments are possible without departing from the spirit and scope of the invention as defined in the appended claims, and equivalents thereof.

What is claimed is:

1. A projectile further comprising:

a pusher assembly further comprising
- a pusher body defining an interior housing, and
- a pusher tail connected to a rear of the pusher body;

a payload housed within the pusher body;

a cap connected to a front of the pusher body for retaining the payload within the pusher body prior to ejection;

a payload ejector located within the pusher body and to a rear of the payload assembly;

a charge assembly for deploying the payload at a desired time after exiting a weapon barrel;

a sabot assembly coaxial with and partially surrounding the pusher assembly; and a segmented slip band coaxial with and seated in a groove on an exterior of the sabot assembly, wherein the segmented slip band rotates freely within the groove thereby minimizing the spin imparted on the pusher body and separates into one or more segments upon exit from a weapon system.

2. The projectile of claim 1 wherein the segmented slip band separates from the sabot assembly upon exiting a gun barrel without the sabot assembly imparting force to break the segmented slip band apart.

3. The projectile of claim 1 wherein the segmented slip band further comprises a groove for receiving a corresponding protrusion of a cartridge case to hold the segmented slip band in place prior to being fired.

4. The projectile of claim 2 wherein the segmented slip band further comprises three segments.

5. The projectile of claim 2 wherein the sabot assembly further comprises three sabots.

6. The projectile of claim 1 wherein the projectile is sized and dimensioned to be fired from a forty millimeter weapon system.

7. The projectile of claim 1 wherein the payload comprises one or more of the following: steel pellets, tungsten pellets, plastic pellets, rubber pellets, powders, streamers.

8. The projectile of claim 1 wherein the cap is attached to the pusher body by a snap fit.

9. The projectile of claim 8 wherein the sabot assembly does not extend to the cap.

10. The projectile of claim 1 wherein the sabot assembly and the pusher tail each comprise corresponding interface features.

11. The projectile of claim 1 wherein the drag profile of the pusher tail is selected according to a desired payload distance.

12. The projectile of claim 1 wherein the charge assembly pushes the payload ejector forward thereby translating the payload forward to separate the cap from the pusher body and eject the payload.

13. The projectile of claim 12 wherein the charge assembly further comprises:

a delay column located in a rear of the pusher tail and ignited by a propellant charge of the projectile, said delay column configured for burning a predetermined amount of time before igniting an energetic charge;

the energetic charge, ignited by the delay column and configured for pushing the payload ejector forward.

14. The projectile of claim 12 wherein the charge assembly is selected from the following: a pyrotechnic delay, a time based fuze, a radio frequency programmable fuze, and a command detonation fuze.

15. The projectile of claim 1 wherein the charge assembly pushes the payload ejector forward thereby translating the payload forward to separate the cap from the pusher body and eject the payload with enough force to reduce the forward momentum of the pusher.

16. A forty millimeter projectile further comprising:

a pusher assembly further comprising
- a pusher body defining an interior housing, and
- a pusher tail connected to the rear of the pusher body;

a pellet payload housed within the pusher body;

a cap snap fit connected to the front of the pusher body for retaining the payload within the pusher body prior to ejection;

a payload ejector located within the pusher body and to a rear of the payload assembly;

a delay column located in a rear of the pusher tail and ignited by a propellant charge of the projectile, said delay column configured for burning a predetermined amount of time before igniting an energetic charge, said predetermined amount of time selected to achieve a desired range before ejecting the payload;

the energetic charge, ignited by the delay column and configured for pushing the payload ejector forward thereby translating the payload forward to separate the cap from the pusher body and eject the payload;

a sabot assembly coaxial with and partially surrounding the pusher assembly; and a segmented slip band coaxial with and seated in a groove on an exterior of the sabot assembly, wherein the segmented slip band rotates freely within the groove thereby minimizing the spin imparted on the pusher body and separates into one or more segments upon exit from a weapon system, said segmented slip band further comprising a groove for receiving a corresponding protrusion of a cartridge case to hold the segmented slip band in place prior to being fired.

* * * * *